US008986504B1

(12) United States Patent
Eckl et al.

(10) Patent No.: US 8,986,504 B1
(45) Date of Patent: Mar. 24, 2015

(54) DIGESTER APPARATUS

(71) Applicant: International Paper Company, Memphis, TN (US)

(72) Inventors: Ronald A. Eckl, Florence, AL (US); Alyce S. Alt, Madison, AL (US); Kenton Witherspoon, Killen, AL (US); Jesse T. McClung, Birmingham, AL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 14/062,966

(22) Filed: Oct. 25, 2013

(51) Int. Cl.
*D21C 7/14* (2006.01)
*D21C 7/06* (2006.01)

(52) U.S. Cl.
CPC ..... *D21C 7/14* (2013.01)
USPC ..... 162/246; 162/249; 162/251

(58) Field of Classification Search
CPC ..... D21C 7/10; D21C 7/06; D21C 7/14; D21C 3/24; D21C 7/12; D21C 7/08; Y10S 423/03
USPC ..... 162/233, 236, 239, 246, 249, 251; 423/DIG. 3
See application file for complete search history.

(56) References Cited

U.S. PATENT DOCUMENTS 2,946,669 A * 7/1960 Coulter et al. ..... 422/185
3,081,820 A * 3/1963 Schnyder ..... 162/246
3,298,899 A 1/1967 Laakso
4,071,399 A 1/1978 Prough
4,221,632 A 9/1980 Loe, Jr.
4,260,225 A 4/1981 Walles
4,547,264 A 10/1985 Sherman et al.
4,578,149 A 3/1986 Fagerlund
4,693,785 A 9/1987 Laakso (Continued)

FOREIGN PATENT DOCUMENTS

EP 0313730 3/1989
EP 0375800 7/1990

(Continued)

OTHER PUBLICATIONS

N Hartler J Libert, "The behavior of certain inorganic ions in the wood/white/liquor system," Svensk Papperstid., 76 (12): 454-457, 1973.

(Continued)

*Primary Examiner* — Jose Fortuna
(74) *Attorney, Agent, or Firm* — Thomas W. Barnes, III; Robert L. Showalter

(57) ABSTRACT

A digester apparatus is provided for delignifying wood chips to form wood pulp comprising: a vessel, a first downcomer, an outer fluid supply downcomer and structure defining an insulating region between the first and outer downcomers. The first downcomer extends into the vessel for delivering a first fluid into the vessel. The first fluid is generally at a first temperature when passing into the first downcomer. The outer fluid supply downcomer extends into the vessel and may be located about the first downcomer for supplying a second fluid into the vessel. The second fluid may be generally at a second temperature different from the first temperature when passing into the outer downcomer. The structure defining an insulating region between the first and outer downcomers functions to reduce heat transfer between the first and outer downcomers.

7 Claims, 4 Drawing Sheets

(56) References Cited

U.S. PATENT DOCUMENTS

| | | | | |
|---|---|---|---|---|
| 4,755,258 | A | 7/1988 | Ryham et al. | |
| 4,963,229 | A | 10/1990 | Lisnyansky et al. | |
| 5,080,755 | A | 1/1992 | Backlund | |
| 5,192,396 | A | 3/1993 | Backland | |
| 5,254,286 | A | 10/1993 | Gill et al. | |
| 5,256,255 | A | 10/1993 | Fagerlund | |
| 5,300,195 | A * | 4/1994 | Richter et al. | 162/246 |
| 5,401,361 | A | 3/1995 | Prough et al. | |
| 5,413,677 | A | 5/1995 | Collins | |
| 5,441,602 | A | 8/1995 | Harris et al. | |
| 5,489,363 | A | 2/1996 | Marcoccia et al. | |
| 5,536,366 | A | 7/1996 | Marcoccia et al. | |
| 5,547,012 | A | 8/1996 | Marcoccia et al. | |
| 5,575,890 | A | 11/1996 | Prough et al. | |
| 5,620,562 | A | 4/1997 | Marcoccia et al. | |
| 5,635,026 | A | 6/1997 | Kettunen et al. | |
| 5,650,045 | A | 7/1997 | Salminen | |
| 5,662,775 | A | 9/1997 | Marcoccia et al. | |
| 5,674,359 | A | 10/1997 | Chasse et al. | |
| 5,716,497 | A | 2/1998 | Richter et al. | |
| 5,753,075 | A | 5/1998 | Stromberg et al. | |
| 5,795,438 | A | 8/1998 | Stromberg et al. | |
| 5,824,187 | A | 10/1998 | Richter et al. | |
| 5,824,188 | A | 10/1998 | Prough et al. | |
| 5,849,150 | A | 12/1998 | Marcoccia et al. | |
| 5,849,151 | A | 12/1998 | Marcoccia et al. | |
| 5,958,181 | A | 9/1999 | Stromberg et al. | |
| 5,985,096 | A | 11/1999 | Marcoccia et al. | |
| 6,086,712 | A | 7/2000 | Marcoccia et al. | |
| 6,090,240 | A | 7/2000 | Eneberg et al. | |
| 6,103,058 | A | 8/2000 | Engstrom | |
| 6,106,668 | A | 8/2000 | Stromberg et al. | |
| 6,123,807 | A | 9/2000 | Engstrom et al. | |
| 6,132,556 | A | 10/2000 | Stromberg et al. | |
| 6,146,495 | A | 11/2000 | Duggirala et al. | |
| 6,159,336 | A | 12/2000 | Engstrom et al. | |
| 6,159,337 | A | 12/2000 | Marcoccia et al. | |
| 6,203,662 | B1 | 3/2001 | Snekkenes et al. | |
| 6,232,419 | B1 | 5/2001 | Duggirala et al. | |
| 6,235,151 | B1 | 5/2001 | Fagerlind et al. | |
| 6,235,152 | B1 | 5/2001 | Duggirala et al. | |
| 6,241,851 | B1 | 6/2001 | Marcoccia | |
| 6,277,240 | B1 | 8/2001 | Marcoccia et al. | |
| 6,280,568 | B1 | 8/2001 | Marcoccia et al. | |
| 6,346,167 | B2 | 2/2002 | Marcoccia et al. | |
| 6,939,439 | B1 | 9/2005 | Paakki et al. | |
| 7,279,070 | B2 * | 10/2007 | Snekkenes et al. | 162/71 |
| 7,452,444 | B2 | 11/2008 | Lawrence et al. | |
| 7,566,380 | B2 | 7/2009 | Snekkenes | |
| 7,749,354 | B2 | 7/2010 | Lawrence et al. | |
| 7,918,967 | B2 | 4/2011 | Jiang et al. | |
| 8,647,469 | B2 * | 2/2014 | Trolin et al. | 162/17 |
| 2001/0035271 | A1 | 11/2001 | Duggirala et al. | |
| 2002/0069986 | A1 | 6/2002 | Marcoccia et al. | |
| 2002/0129911 | A1 | 9/2002 | Marcoccia et al. | |
| 2003/0010458 | A1 | 1/2003 | Thompson et al. | |
| 2003/0075290 | A1 | 4/2003 | Thompson et al. | |
| 2004/0060672 | A1 * | 4/2004 | Snekkenes et al. | 162/19 |
| 2005/0274467 | A1 * | 12/2005 | Lawrence et al. | 162/49 |
| 2009/0056890 | A1 * | 3/2009 | Lawrence et al. | 162/48 |
| 2013/0240167 | A1 * | 9/2013 | Trolin et al. | 162/17 |

FOREIGN PATENT DOCUMENTS

| | | |
|---|---|---|
| EP | 0937813 | 8/1999 |
| SU | 1252415 | 8/1980 |
| WO | WO 9423120 A1 * | 10/1994 |
| WO | WO0011263 | 3/2000 |
| WO | WO0125531 | 4/2001 |

OTHER PUBLICATIONS

L D Markham J.R. Bryce, "Formation of calcium carbonate scale in a continuous digester," Tappl J. 63(4); 125-127, 1980.

Smart Filtrate Addition—Glens Falls Group offers a simple, low cost, high return modification for continuous cooking systems, Fiber and PulpIndustry Jul. 2002.

W. W. Al-Dajani G. Gellerstedt, "Cooking parameters controlling the light absorption coeficient of alkaline pulps," Proceedings of the 11th International Symposium on wood and pulping chemistry, Nice,France, Jun. 11-14, 2001, vol. 1, Oral presentations, pp. 83-86, Royal Institute of Technology.

New Filtrate Addition System results in Improved Digester performance, the average blowline consistency target has been raised from 10% to 11.5%, Gerry Pageau, Howe Sound Pulp and Paper, Canada vol. 103, No. 10, Oct. 2002, pp. 36-41.

* cited by examiner

DIGESTER APPARATUS

FIELD OF THE INVENTION

The present invention relates to a digester apparatus for receiving wood chips, heating the wood chips under elevated pressure and temperature in a cooking liquor and generating pulp.

BACKGROUND OF THE INVENTION

In a known digester apparatus, a plurality of centrally located concentric pipes are provided. An inner surface of the inner-most pipe defines a wash downcomer for providing a cold blow filtrate for cooling and washing pulp near the base of the digester apparatus. A cooking downcomer is defined by the outer surface of the inner-most pipe and the inner surface of a directly adjacent second-inner-most pipe. The cooking liquor flows through the cooking downcomer and exits near a mid-point of the digester apparatus. The temperature of the cold blow filtrate entering the wash downcomer may be from about 120° F. to about 160° F., while the temperature of the cooking liquor entering the cooking downcomer may be at a temperature of from about 285° F. to about 340° F. However, because the wash and cooking downcomers are directly adjacent to one another, undesirable heat transfer occurs between the two downcomers, which makes the overall process less efficient and effective.

SUMMARY OF THE INVENTION

In accordance with a first aspect of the present invention, a digester apparatus is provided for delignifying wood chips to form wood pulp. The digester apparatus comprises: a vessel, a first downcomer, a second downcomer and a third downcomer. The first downcomer extends into the vessel for delivering a first fluid into the vessel. The first fluid is generally at a first temperature when passing into the first downcomer. The second downcomer extends into the vessel and is located about the first downcomer. The third downcomer extends into the vessel and is located about the second downcomer for delivering a second fluid into the vessel. The second fluid is generally at a second temperature different from the first temperature when passing into the third downcomer. The digester apparatus further comprises structure for preventing continuous liquid flow through the second downcomer such that the second downcomer defines an insulating region between the first and third downcomers so as to reduce heat transfer between the first and third downcomers.

The first downcomer may be defined by a first pipe extending into the vessel. The second downcomer may be defined by an outer surface of the first pipe and an inner surface of a second pipe. The third downcomer may be defined by an outer surface of the second pipe and an inner surface of a third pipe.

The structure for preventing continuous liquid flow through the second downcomer may comprise a closed valve coupled to a second pipe inlet, a closed second pipe inlet, a closed lower end of the second pipe or other like structure.

The digester apparatus may further comprise: first fluid supply structure for supplying a cold blow filtrate defining the first fluid to the first downcomer, and second fluid supply structure for supplying a cooking liquor defining the second fluid to the third downcomer. The cooking liquor supplied to the third downcomer may be at a temperature greater than a temperature at which the cold blow filtrate is supplied to the first downcomer. In one embodiment, the first fluid supply structure supplies the cold blow filtrate to the first downcomer at a temperature of from about 120 degrees F. to about 160 degrees F. and the second fluid supply structure supplies the cooking liquor to the third downcomer at a temperature of from about 285 degrees F. to about 340 degrees F.

The first pipe may extend to a location near a bottom of the vessel. The third pipe may extend to a location near a mid-point of the vessel.

In accordance with a second aspect of the present invention, a digester apparatus is provided for delignifying wood chips to form wood pulp comprising: a vessel, a first downcomer, an outer fluid supply downcomer and structure defining an insulating region between the first and outer downcomers. The first downcomer extends into the vessel for delivering a first fluid into the vessel. The first fluid is generally at a first temperature when passing into the first downcomer. The outer fluid supply downcomer extends into the vessel and may be located about the first downcomer for supplying a second fluid into the vessel. The second fluid may be generally at a second temperature different from the first temperature when passing into the outer downcomer. The structure defining an insulating region between the first and outer downcomers functions to reduce heat transfer between the first and outer downcomers.

In accordance with a first embodiment, the first downcomer is defined by a first pipe extending into the vessel. The insulating structure comprises an outer surface of the first pipe, an inner surface of a second pipe and an insulating passage therebetween. The outer fluid supply downcomer is defined by an outer surface of the second pipe and an inner surface of a third pipe. In one embodiment, a second pipe inlet is coupled to a closed valve so as to prevent an on-going continuous flow of liquid into or out of the insulating passage. The second pipe comprises openings near its lower end. A liquid is able to enter the insulating passage through these openings in the second pipe until the insulating passage is filled. The liquid becomes generally stagnant after entering the insulating passage because the closed valve coupled to the second pipe inlet prevents the continuous flow of liquid through the insulating passage once the passage is filled with liquid. The stagnant liquid within the insulating passage functions as an insulator to reduce heat transfer between the first downcomer and the outer downcomer.

In another embodiment, the inlet connected to the second pipe is open to atmosphere, while the second pipe is closed at its lower end. The insulating passage fills with air flowing through the inlet, but does not receive a liquid. After the air fills the insulating passage, it generally functions as an insulator to reduce heat transfer from the first downcomer to the outer downcomer.

The digester apparatus further comprises: first fluid supply structure for supplying a cold blow filtrate defining the first fluid to the first downcomer, and second fluid supply structure for supplying a cooking liquor defining the second fluid to the outer fluid supply downcomer. The cooking liquor supplied to the outer fluid supply downcomer may be at a temperature greater than a temperature at which the cold blow filtrate is supplied to the first downcomer.

The first pipe may extend to a location near a bottom of the vessel and the third pipe may extend to a location near a mid-point of the vessel.

In accordance with a second embodiment, the insulating structure comprises an insulating layer on an inner surface of a first pipe. The first downcomer is defined by an inner surface of the insulating layer on the first pipe inner surface. The outer fluid supply downcomer is defined by an outer surface of the first pipe and an inner surface of a second pipe.

In the second embodiment, the digester apparatus further comprises: first fluid supply structure for supplying a cold blow filtrate defining the first fluid to the first downcomer, and second fluid supply structure for supplying a cooking liquor defining the second fluid to the outer fluid supply downcomer. The cooking liquor supplied to the outer fluid supply downcomer may be at a temperature greater than a temperature at which the cold blow filtrate is supplied to the first downcomer.

The first pipe may extend to a location near a bottom of the vessel and the second pipe may extend to a location near a mid-point of the vessel.

In accordance with a third embodiment, the first downcomer is defined by a first pipe extending into the vessel; the insulating structure comprises an insulating layer on an outer surface of the first pipe; and the outer fluid supply downcomer is defined by an outer surface of the insulating layer and an inner surface of a second pipe.

In the third embodiment, the digester apparatus further comprises: first fluid supply structure for supplying a cold blow filtrate defining the first fluid to the first downcomer; and second fluid supply structure for supplying a cooking liquor defining the second fluid to the outer fluid supply downcomer. The cooking liquor supplied to the outer fluid supply downcomer is at a temperature greater than a temperature at which the cold blow filtrate is supplied to the first downcomer.

The first pipe may extend to a location near a bottom of the vessel and the second pipe may extend to a location near a mid-point of the vessel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
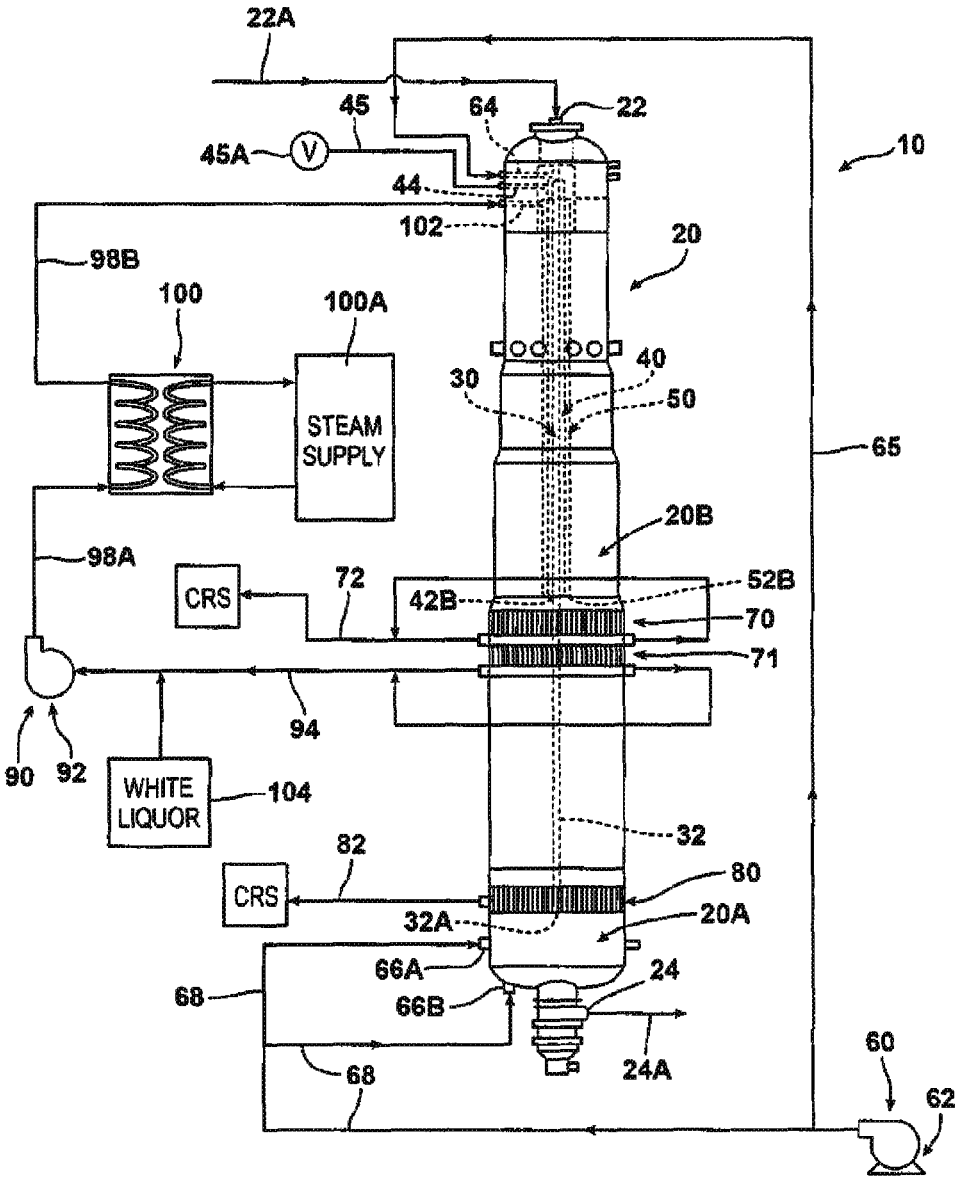
FIG. 1 is a side view of a digester apparatus constructed in accordance with a first embodiment of the present invention.

A continuous digester apparatus 10 constructed in accordance with a first embodiment is illustrated in FIG. 1. The digester apparatus 10 comprises a generally vertical cooking vessel 20 operated under pressure (e.g., from about 130 psig to about 170 psig, with the pressure being measured about two-thirds up from a bottom of the vessel 20) and at an elevated temperature (from about 285 degrees F. to about 340 degrees F.). Wood chips and alkali liquor (white liquor) are introduced through an inlet line 22A into an inlet opening 22 of the vessel 20. During a continuous descent of the wood chips through the vessel 20, they react with the white liquor such that the lignin in the chips is chemically broken down to free the cellulosic material in the chips and to form pulp suitable for paper making and the like. The pulp exits the vessel 20 through an exit line 24A coupled to an exit opening 24 in the vessel 20.

Figure 2:
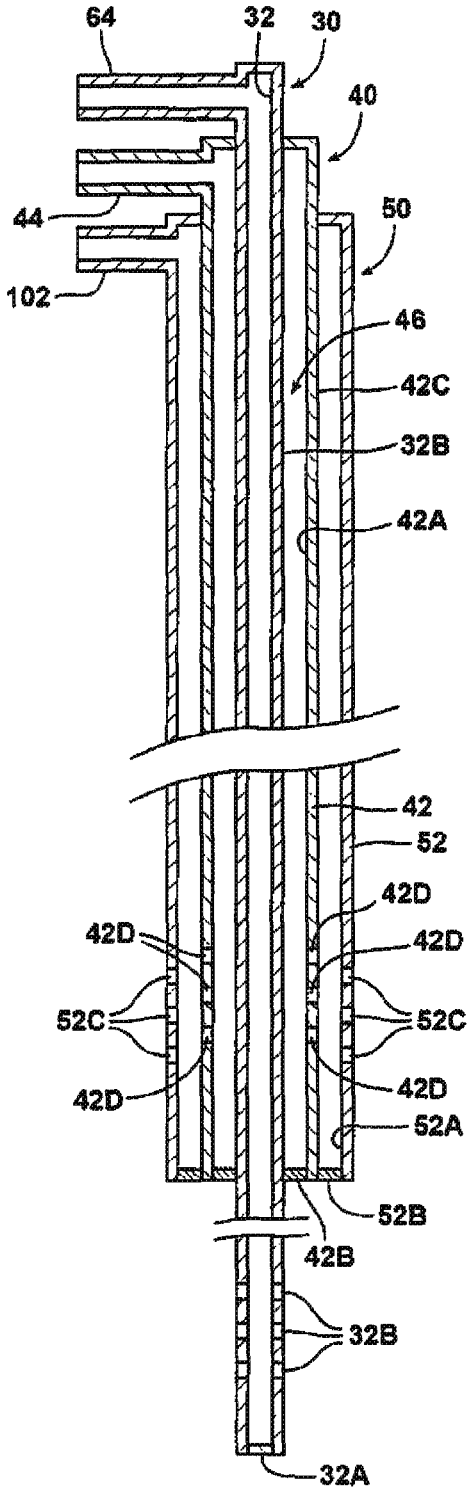
FIG. 2 is a cross sectional view of first, second and third downcomers of the digester apparatus in FIG. 1.

The digester apparatus 10 further comprises a first downcomer 30, a second downcomer 40 and a third downcomer 50, see FIGS. 1 and 2. The first downcomer 30 is defined by a first pipe 32 generally centrally located in the vessel 20. As illustrated in FIG. 2, the first pipe 32 is closed at a lower end 32A and has openings 32B positioned above the lower end 32A. The openings 32B are located near a bottom 20A of the vessel 20. As will be discussed further below, the first downcomer 30 receives a first fluid at a first temperature and delivers the first fluid via the openings 32B to a location within the vessel 20 near the vessel bottom 20A.

The second downcomer 40 extends into the vessel 20 and is located about the first downcomer 30. The second downcomer 40 is defined by an outer surface 32C of the first pipe 32 and an inner surface 42A of a second pipe 42. The second pipe 42 is concentric with, directly adjacent to and spaced from the first pipe 32. The second pipe 42 has a closed lower end 42B located within the vessel 20 near a mid-point 20B within the vessel 20, see FIG. 1. The second pipe 42 further comprises openings 42D positioned above the lower end 42B and near the vessel mid-point 20B. In the illustrated embodiment, the second pipe 42 communicates with an inlet 44 coupled to the second pipe 42. A fluid line 45 extends from the inlet 44 to a valve 45A, which, in the illustrated embodiment, is closed to prevent a liquid from flowing into the second downcomer 40 through the fluid line 45. Hence, because the valve 45A is closed, a continuous flow of fluid from the valve 45A, through the fluid line 45 and the inlet 44 and into the second downcomer 40 is prevented. Further prevented is a continuous flow of fluid from the second downcomer 40, through the inlet 44 and the fluid line 45 and out of the valve 45A. As will be discussed below, the second downcomer 40 defines an insulating region 46 between the first and third downcomers 30 and 50.

The third downcomer 50 (also referred to herein as an "outer fluid supply downcomer") extends into the vessel 20 and is located about the second downcomer 40. The third downcomer 50 is defined by an outer surface 42C of the second pipe 42 and an inner surface 52A of a third pipe 52. The third pipe 52 is concentric with, directly adjacent to and spaced from the second pipe 42. The third pipe 52 is closed at a lower end 52B and has openings 52C positioned above the lower end 52B. The openings 52C are located within the vessel 20 near the mid-point 20B of the vessel 20. As will be discussed further below, the third downcomer 50 receives a second fluid at a second temperature different from the first temperature and delivers the second fluid via the openings 52C to a location within the vessel 20 near the vessel mid-point 20B.

The digester apparatus 10 further comprises first fluid supply structure 60 for supplying a cold blow filtrate defining the first fluid to the first downcomer 30. The first fluid supply structure 60 comprises a first pump 62, an inlet 64 coupled to the first pipe 32 and a first fluid supply line 65 extending from the first pump 62 to the inlet 64. The cold blow filtrate is supplied to the first pump 62 by a supply apparatus (not shown), wherein the cold blow filtrate comprises wash water from a downstream pulp washing operation. The first pump 62 pumps the cold blow filtrate through the first fluid supply line 65, to the inlet 64, and into and through the first pipe 32 such that the cold blow filtrate enters the vessel 20 near the bottom 20A of the vessel 20. The cold blow filtrate functions as a wash liquid to wash the pulp located near the vessel bottom 20A. In the illustrated embodiment, the temperature of the cold blow filtrate entering the first pipe 32 is from about 120 degrees F. to about 160 degrees F. The first pump 62 also supplies cold blow filtrate to nozzles 66A and 66B coupled to the vessel 20 via fluid supply lines 68 for further washing the pulp, see FIG. 1.

First and second extraction screens 70 and 71, respectively, are provided in the vessel 20 near the mid-point 20B of the vessel 20. Fluid containing dissolved chip mass (i.e., black liquor) from within the vessel 20 passes through the first and second extraction screens 70 and 71. Extracted fluid flowing through the first extraction screens 70 exits through an extraction line 72 to a chemical recovery system CRS, as is well known in the art. Fluid flowing through the second extraction screens 71 is received by a second fluid supply structure 90 as discussed below. The amount of fluid pulled from the vessel 20 through the second extraction screens 71 and the amount of white liquor (discussed below) added to the fluid extracted through the second screens 71 is generally equal to the amount of the second fluid exiting the third downcomer 50 and entering the vessel 20.

Third extraction screens 80 are provided in the vessel 20 near the bottom 20A of the vessel 20. Further fluid containing dissolved chip mass (i.e., black liquor) from within the vessel 20 passes through the extraction screens 80. The extracted fluid exits through an extraction line 82 to the chemical recovery system CRS, as is well known in the art. The amount of fluid pulled from the vessel 20 through the first and third extraction screens 70 and 80 is generally close to the amount of cold blow filtrate exiting the first pump 62.

The digester apparatus 10 also comprises second fluid supply structure 90 for supplying a cooking liquor defining the second fluid to the third downcomer 50. The second fluid supply structure 90 comprises a second pump 92, a fluid extraction line 94 extending from the second extraction screens 71 to the second pump 92, second and third fluid supply lines 98A and 98B, respectively, a heat exchanger 100 and an inlet 102 coupled to the third pipe 52. A white liquor supply source 104 supplies white liquor (i.e., alkali liquor) to the extraction line 94 such that the white liquor is combined with the black liquor extracted through the second extraction screens 71 to define a cooking liquor. The cooking liquor may comprise about 10% by volume white liquor and about 90% by volume back liquor. The second pump 92 pumps the cooking liquor through second fluid supply line 98A to the heat exchanger 100, where the cooking liquor is heated to a temperature of from about 285 degrees F. to about 340 degrees F. The heat exchanger 100 receives steam from a steam supply 100A, which provides energy in the form of heat to heat the cooking liquor. From the heat exchanger 100, the cooking liquor is pumped to the inlet 102, and into and through the third downcomer 50 such that the cooking liquor enters the vessel 20 near the mid-point 20B of the vessel 20 so as to provide fresh cooking liquor to the vessel mid-point 20B. The fresh cooking liquor functions to further drive the delignification process of the wood chips as they continue to travel from the mid-point 20B within the vessel to the bottom 20A of the vessel. In the illustrated embodiment, the temperature of the cooking liquor entering the third downcomer 50 is from about 285 degrees F. to about 340 degrees F.

As noted above, the second downcomer 40 defines an insulating region 46 between the first and third downcomers 30 and 50. In the illustrated embodiment, a liquid, such as water added to the vessel 20 prior to the wood chips and alkali liquor being introduced into the vessel 20, flowing through the third pipe openings 52C into the third downcomer 50, is permitted to flow through the openings 42D in the second pipe 42 so as to fill the second downcomer 40. The liquid in the second downcomer 40 may extend all the way to the closed valve 45A. It is contemplated that after wood chips and alkali liquor have been added to the vessel 20, other liquids, such as cold blow filtrate and/or cooking liquor may diffuse into the second downcomer 40. Once the second downcomer 40 has been filled with liquid, the liquid becomes stagnant since the closed valve 45A prevents continuous liquid flow through the second downcomer 40. The stagnant liquid functions as an insulator within the insulating region 46 between the first and third downcomers 30 and 50. In this embodiment, the closed valve 45A defines structure for preventing continuous liquid flow through the second downcomer 40.

It is further contemplated that the inlet 44 coupled to the second pipe could be open to atmosphere and the second pipe could be closed at its lower end and, further, not have any openings near its lower end so as to prevent liquid from entering the second downcomer. In this embodiment, air would flow into the second downcomer, stagnate and function as an insulator within the insulating region between the first and third downcomers. The second pipe having a closed lower end without openings would define the structure for preventing continuous liquid flow through the second downcomer 40.

The insulating region 46 minimizes heat transfer from the cooking liquor flowing through the third downcomer 50 to the cold blow filtrate flowing through the first downcomer 30. By reducing the heat transfer between the cooking liquor and cold blow filtrate, the digester apparatus 10 operates more efficiently than those of the prior art, thereby reducing energy input requirements and lowering costs. Further advantages to reducing heat transfer between the cooking liquor and cold blow filtrate include improved pulp washing, improved pulp strength and improved pulp quality.

Figure 3:
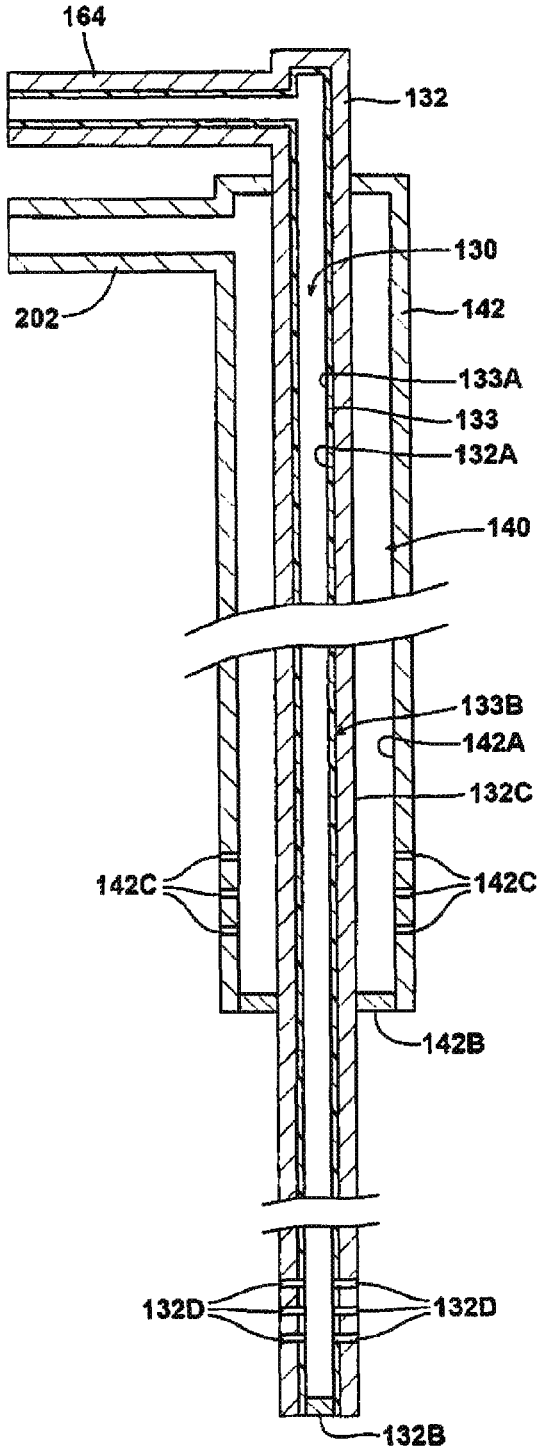
FIG. 3 is a cross section view of a first downcomer, an outer fluid supply downcomer, and structure defining an insulating region between the first and outer downcomers of a digester apparatus of a second embodiment.

In accordance with a second embodiment, a digester apparatus is provided which is constructed in essentially the same manner as the digester apparatus 10 illustrated in FIG. 1, however, the first, second and third downcomers 30, 40 and 50 are replaced by first and second downcomers 130 and 140, respectively, as illustrated in FIG. 3. The first downcomer 130 is defined by an inner surface 133A of an insulating layer 133 provided on an inner surface 132A of a first pipe 132 generally centrally located within a corresponding vessel, which is similar to vessel 20. As illustrated in FIG. 3, the first pipe 132 is closed at a lower end 132B, which is located near a bottom of the vessel. The first pipe 132 comprises openings 132D positioned above the first pipe lower end 132B. As will be discussed further below, the first downcomer 130 receives a first fluid at a first temperature and delivers the first fluid via the openings 132D to a location within the vessel near the vessel bottom.

The second downcomer 140 (also referred to herein as an "outer fluid supply downcomer") extends into the vessel and is located about the first downcomer 130. The second downcomer 140 is defined by an outer surface 132C of the first pipe 132 and an inner surface 142A of a second pipe 142. The second pipe 142 is concentric with, directly adjacent to and spaced from the first pipe 132. The second pipe 142 is closed at a lower end 142B located within the vessel near a mid-point within the vessel. The second pipe 142 comprises openings 142C positioned above the second pipe lower end 142B.

The insulating layer 133 on the first pipe inner surface 132A may comprise a liner formed from polytetraflouroethylene sold by E.I. Du Pont de Nemours and Co. under the product designation "TEFLON®. It is also contemplated that the insulating layer may be formed from other alkali resistant materials. The insulating layer 133 defines an insulating region 133B between the first and second downcomers 130 and 140.

The digester apparatus of the second embodiment further comprises a first fluid supply structure, which is substantially the same as the first fluid supply structure 60 illustrated in FIG. 1. The first fluid supply structure of the second embodiment includes a first pump, an inlet 164 coupled to the first pipe 132 and a first fluid supply line extending from the first pump to the inlet 164. The first fluid supply structure of the second embodiment functions to supply a cold blow filtrate defining the first fluid to the first downcomer 130. The cold blow filtrate functions as a wash liquid to wash and cool the pulp located near the vessel bottom. In the illustrated embodiment, the temperature of the cold blow filtrate entering the first pipe 132 is from about 120 degrees F. to about 160 degrees F.

The digester apparatus of the second embodiment further comprises a second fluid supply structure, which is substantially the same as the second fluid supply structure 90 illustrated in FIG. 1, but instead of the second fluid supply structure supplying cooking liquor to the third downcomer 50 as in the first embodiment, the second fluid supply structure of the second embodiment supplies cooking liquor to the second downcomer 140. The second fluid supply structure of the second embodiment comprises a second pump, a fluid extraction line extending from second extraction screens of the vessel to the second pump, second and third fluid supply lines, a heat exchanger and an inlet 202 coupled to the second pipe 142. Just as in the first embodiment, white liquor (i.e., alkali liquor) is supplied to the extraction line such that the white liquor is combined with the black liquor extracted through the second extraction screens to define a cooking liquor. The second pump pumps the cooking liquor through the second fluid supply line to the heat exchanger, where the cooking liquor is heated to a temperature of from about 285 degrees F. to about 340 degrees F. From the heat exchanger, the cooking liquor is pumped to the inlet 202, and into and through the second downcomer 140 such that the cooking liquor enters the vessel near the mid-point of the vessel so as to provide heated and enriched cooking liquor to the vessel mid-point. In the illustrated embodiment, the temperature of the cooking liquor is from about 285 degrees F. to about 340 degrees F.

As noted above, the insulating layer 133 on the inner surface 132A of the first pipe 132 defines an insulating region 133B between the first and second downcomers 130 and 140. The insulating region 133B minimizes heat transfer from the cooking liquor flowing through the second downcomer 140 to the cold blow filtrate flowing through the first downcomer 130. By reducing the heat transfer between the cooking liquor and the cold blow filtrate, the digester apparatus of the second embodiment operates more efficiently than those of the prior art, thereby reducing energy input requirements and lowering costs. Further advantages to reducing heat transfer between the cooking liquor and the cold blow filtrate include improved pulp washing, improved pulp strength and improved pulp quality.

Figure 4:
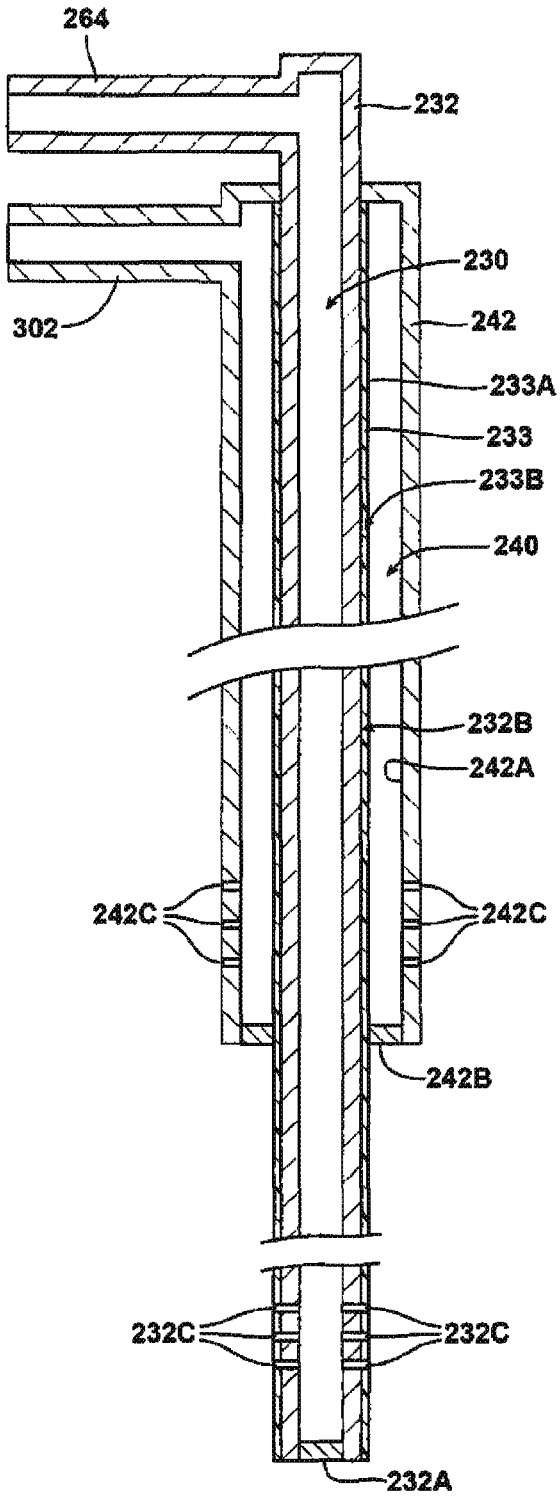
FIG. 4 is a cross section view of a first downcomer, an outer fluid supply downcomer, and structure defining an insulating region between the first and outer downcomers of a digester apparatus of a third embodiment.

In accordance with a third embodiment, a digester apparatus is provided which is constructed in essentially the same manner as the digester apparatus 10 illustrated in FIG. 1, however, the first, second and third downcomers 30, 40 and 50 are replaced by first and second downcomers 230 and 240, respectively, as illustrated in FIG. 4. The first downcomer 230 is defined by a first pipe 232 generally centrally located within a corresponding vessel, which is similar to vessel 20. As illustrated in FIG. 4, the first pipe 232 is closed at a lower end 232A, which is located near a bottom of the vessel. The first pipe 232 comprises openings 232C which are located above the lower end 232A. As will be discussed further below, the first downcomer 230 receives a first fluid at a first temperature and delivers the first fluid via the openings 232C to a location within the vessel near the vessel bottom.

The second downcomer 240 (also referred to herein as an "outer fluid supply downcomer") extends into the vessel and is located about the first downcomer 230. The second downcomer 240 is defined by an outer surface 233A of an insulating layer 233 provided about an outer surface 232B of the first pipe 232 and an inner surface 242A of a second pipe 242. The second pipe 242 is concentric with, directly adjacent to and spaced from the first pipe 232. The second pipe 242 is closed at a lower end 242B, which is located within the vessel near a mid-point within the vessel. The second pipe 242 comprises a plurality of openings 242C located above the lower end 242B. The insulating layer 233 may comprise a liner formed from polytetraflouroethylene sold by E.I. Du Pont de Nemours and Co. under the product designation "TEFLON®. It is also contemplated that the insulating layer could be formed from other alkali resistant materials. The insulating layer 233 defines an insulating region 233B between the first and second downcomers 230 and 240.

The digester apparatus of the third embodiment further comprises a first fluid supply structure, which is substantially the same as the first fluid supply structure 60 illustrated in FIG. 1. The first fluid supply structure of the third embodiment includes a first pump, an inlet 264 coupled to the first pipe 232 and a first fluid supply line extending from the first pump to the inlet 264. The first fluid supply structure of the third embodiment functions to supply a cold blow filtrate defining the first fluid to the first downcomer 230. The cold blow filtrate functions as a wash liquid to wash and cool the pulp located near the vessel bottom. In the illustrated embodiment, the temperature of the cold blow filtrate entering the first pipe 232 is from about 140 degrees F. to about 150 degrees F.

The digester apparatus of the third embodiment further comprises a second fluid supply structure, which is substantially the same as the second fluid supply structure 90 illustrated in FIG. 1, but instead of the second fluid supply structure supplying cooking liquor to the third downcomer 50 as in the first embodiment, the second fluid supply structure of the third embodiment supplies cooking liquor to the second downcomer 240. The second fluid supply structure of the third embodiment comprises a second pump, a fluid extraction line extending from second extraction screens of the vessel to the second pump, second and third fluid supply lines, a heat exchanger and an inlet 302 coupled to the second pipe 242. Just as in the first embodiment, white liquor (i.e., alkali liquor) is supplied to the extraction line such that the white liquor is combined with the black liquor extracted through the second extraction screens to define a cooking liquor. The second pump pumps the cooking liquor through the second fluid supply line to the heat exchanger, where the cooking liquor is heated to a temperature of from about 285 degrees F. to about 340 degrees F. From the heat exchanger, the cooking liquor is pumped to the inlet 302, and into and through the second downcomer 240 such that the cooking liquor enters the vessel near the mid-point of the vessel so as to provide heated and enriched cooking liquor to the vessel mid-point. In the illustrated embodiment, the temperature of the cooking liquor is from about 285 degrees F. to about 340 degrees F.

As noted above, the insulating layer 233 on the outer surface 232B of the first pipe 232 defines an insulating region 233B between the first and second downcomers 230 and 240. The insulating region minimizes heat transfer from the cooking liquor flowing through the second downcomer 240 to the cold blow filtrate flowing through the first downcomer 230. By reducing the heat transfer between the cooking liquor and the cold blow filtrate, the digester apparatus of the second embodiment operates more efficiently than those of the prior art, thereby reducing energy input requirements and lowering costs. Further advantages to reducing heat transfer between the cooking liquor and the cold blow filtrate include improved pulp washing, improved pulp strength and improved pulp quality.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A digester apparatus for delignifying wood chips to form wood pulp comprising:

a vessel;

a first downcomer extending into said vessel for delivering a first fluid into said vessel, the first fluid being generally at a first temperature when passing into said first downcomer;

a second downcomer extending into said vessel and located about said first downcomer;

a third downcomer extending into said vessel and located about said second downcomer for delivering a second fluid into said vessel, the second fluid being generally at a second temperature different from the first temperature when passing into said third downcomer; and structure for preventing continuous liquid flow through said second downcomer such that said second downcomer defines an insulating region between said first and third downcomers so as to reduce heat transfer between said first and third downcomers.

2. The digester apparatus as set out in claim 1, wherein:

said first downcomer is defined by a first pipe extending into said vessel;

said second downcomer is defined by an outer surface of said first pipe and an inner surface of a second pipe; and said third downcomer is defined by an outer surface of said second pipe and an inner surface of a third pipe.

3. The digester apparatus as set out in claim 2, further comprising:

first fluid supply structure for supplying a cold blow filtrate defining the first fluid to said first downcomer; and second fluid supply structure for supplying a cooking liquor defining the second fluid to said third downcomer, wherein the cooking liquor supplied to said third downcomer is at a temperature greater than a temperature at which the cold blow filtrate is supplied to said first downcomer.

4. The digester apparatus as set out in claim 3, wherein said first fluid supply structure supplies the cold blow filtrate to the first downcomer at a temperature of from about 120 degrees F. to about 160 degrees F.

5. The digester apparatus as set out in claim 4, wherein said second fluid supply structure supplies the cooking liquor to the third downcomer at a temperature of from about 285 degrees F. to about 340 degrees F.

6. The digester apparatus as set out in claim 3, wherein said first pipe extends to a location near a bottom of said vessel.

7. The digester apparatus as set out in claim 6, wherein said third pipe extends to a location near a mid-point of the vessel.

* * * * *